US009181672B2

(12) United States Patent
Nozu et al.

(10) Patent No.: US 9,181,672 B2
(45) Date of Patent: Nov. 10, 2015

(54) METHOD OF SOIL COMPACTION AND DENSIFICATION

(71) Applicants: Fudo Tetra Corporation, Tokyo (JP); Fudo Construction Inc., San Mateo, CA (US)

(72) Inventors: Mitsuo Nozu, Tokyo (JP); Junnosuke Matsumoto, Tokyo (JP); Masaru Sakakibara, San Mateo, CA (US); Kazunori Matsushita, San Mateo, CA (US); Frank Vespi, San Mateo, CA (US)

(73) Assignee: Fudo Tetra Corporation, Tokyo (JP)

( * ) Notice: Subject to any disclaimer, the term of this patent is extended or adjusted under 35 U.S.C. 154(b) by 0 days.

(21) Appl. No.: 14/206,661

(22) Filed: Mar. 12, 2014

(65) Prior Publication Data

US 2014/0294516 A1 Oct. 2, 2014

Related U.S. Application Data

(60) Provisional application No. 61/778,103, filed on Mar. 12, 2013.

(51) Int. Cl.
*E02D 3/046* (2006.01)

(52) U.S. Cl.
CPC ..... *E02D 3/046* (2013.01)

(58) Field of Classification Search
CPC ..... E02D 3/046
USPC ..... 405/271
See application file for complete search history.

(56) References Cited

U.S. PATENT DOCUMENTS

| | | | | |
|---|---|---|---|---|
| 1,650,827 | A * | 11/1927 | Friz | 405/271 |
| 3,245,223 | A | 4/1966 | Degen | |
| 3,945,748 | A | 3/1976 | Berrange | |
| 4,126,007 | A | 11/1978 | Mars | |
| 4,343,568 | A | 8/1982 | Kaltenegger | |
| 4,607,980 | A | 8/1986 | Shilkov et al. | |
| 4,958,962 | A | 9/1990 | Schellhorn | |
| 6,409,426 | B1 | 6/2002 | MacLellan | |
| 6,443,651 | B1 | 9/2002 | Greppmair | |
| 7,931,424 | B2 | 4/2011 | Martin, Sr. | |
| 8,317,426 | B2 | 11/2012 | Steffen | |

* cited by examiner

*Primary Examiner* — Tara M. Pinnock
(74) *Attorney, Agent, or Firm* — McHale & Slavin, P.A.

(57) ABSTRACT

A method of compacting soil performing the steps of establishing a grid pattern of individual partitions at a jobsite, performing a first tamping session to tamper each partition using a 10'×10' vibro tamper plate for about 90 seconds followed by at least 4 days of settling. Performing a second tamping session to tamper each partition using the 10'×10' vibro tamper plate timed for about 120 seconds followed by at least 4 days of settling. Performing a third tamping session to tamper each partition using a 7'×7' vibro tamper plate for about 90 seconds followed by about 6 days of settling.

12 Claims, 4 Drawing Sheets

The location of earthquake where MVT had good effect of liquefaction mitigation

| No | Date | Name of Earthquake | M | Location of MVT improvement |
|---|---|---|---|---|
| A | Jun-78 | Miyagi-ken-oki Earthquake | 7.4 | Onahama-Oil-Tank, Fukushima |
| B | May-83 | Nihonkai-Chubu Earthquake | 7.7 | Niigata Nihonkai LNG Base |
| C | Jan-95 | Hyogo-ken Nambu Earthquake | 7.2 | Kansai International Airport |
| D | Oct-00 | Tottoriken Seibu Earthquake | 7.3 | Miho Airport expansion |
| E | Sep-03 | Tokachi-oki Earthquake | 8.0 | Tomato-Oil Tank base |
| F | Mar-11 | The Tohoku Earthquake | 9.0 | Kawasaki-Steel factory, Kanagawa |

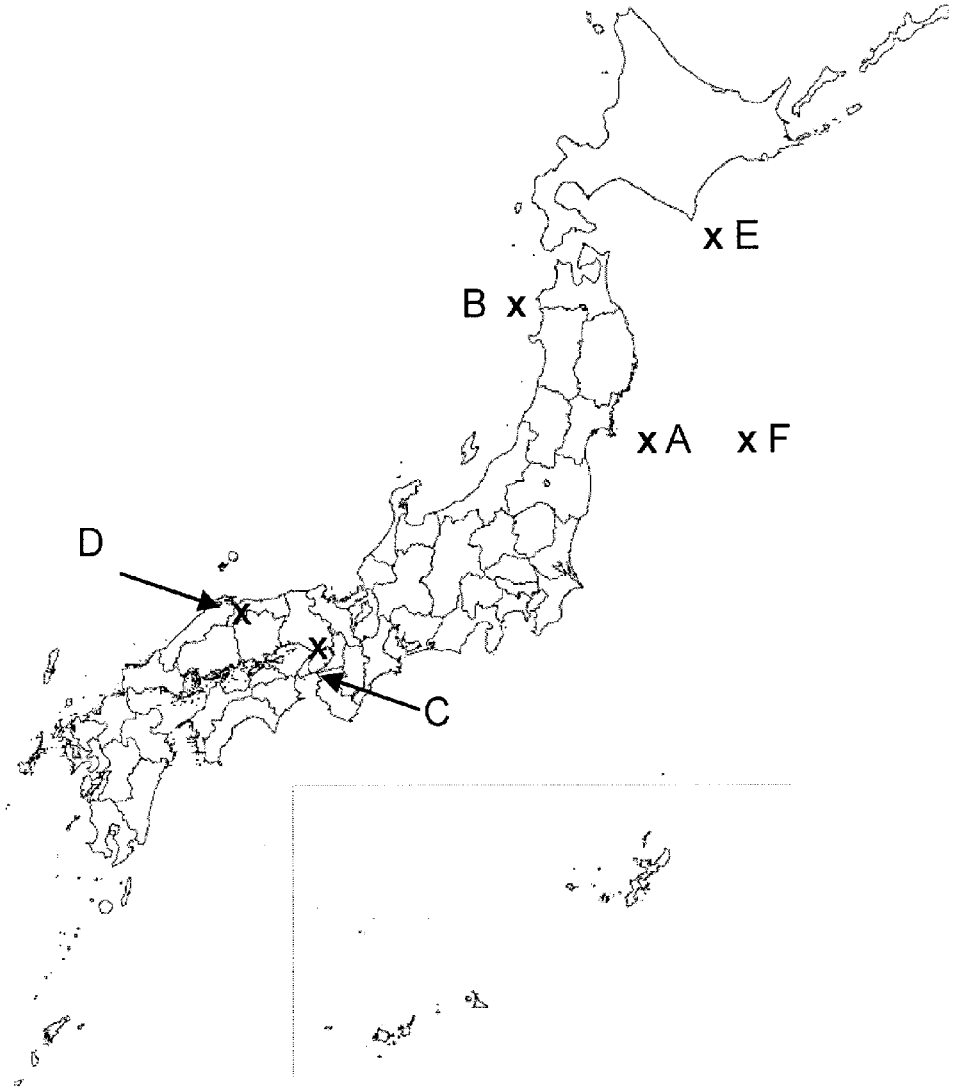

Figure-1

Ref: Sandwich layer structure

| Mammoth Vibro Tamper Type-1 (Large MVT) | | | | Mammoth Vibro Tamper Type-2 (Regular MVT) | | | | Specified Dynamic Compaction (Weight Dropping) | | | |
|---|---|---|---|---|---|---|---|---|---|---|---|
| E=E0 x n x t x 60/(AxBxh) | | | | E=E0 x n x t x 60/(AxBxh) | | | | E=W x H x N/(A x B) | | | tf ft/SF |
| E0=2 x a x (W+F/2)x(f/60) | | | | E0=2 x a x (W+F/2)x(f/60) | | | | | | | |
| Where | | | | Where | | | | Where | | | |
| E0 | Compaction neregy to ground per unit time | | | E0 | Compaction neregy to ground per unit time | | | W | weight | 25 | tons |
| n | Number of Compaction | | 1 | n | Number of Compaction | | 1 | H | height | 110 | ft |
| t | Duration (min) | | 1.67 | t | Duration (min) | | 1.67 | N | Time of drop | 3 | drops |
| A,B | Effective width (cm) | | 304.8 | A,B | Effective width (cm) | | 213.4 | A,B | Effective width | 12 | ft |
| h | Thickness of layer (cm) | | 304.8 | h | Thickness of layer (cm) | | 304.8 | | | | |
| a | Vibration amplotude (cm) | | 2.63 | a | Vibration amplotude (cm) | | 2.63 | | | | |
| W | Weight (tf) | | 25 | W | Weight (tf) | | 11.7 | | | | |
| F | Vibration force (tf) | | 80 | F | Vibration force (tf) | | 60 | | | | |
| f | Frequency (rpm) | | 560 | f | Frequency (rpm) | | 558 | | | | |
| E0= | 3191.07 | tf cm/sec | | E0= | 2039.88 | tf cm/sec | | E= | 57.29 | tf ft/SF | (per unit area) |
| E= | 0.0113 | tf cm/cm3 | | E= | 0.0147 | tf cm/cm3 | | | | | |
| | 112.92 | tf m/m3 | | | 147.25 | tf m/m3 | | | | | |
| E= | 344.17 | tf m/m2 | (per unit area) | E= | 448.83 | tf m/m2 | (per unit area) | | | | |
| | 104.83 | tf ft/SF | (per unit area) | | 136.71 | tf ft/SF | (per unit area) | | | | |

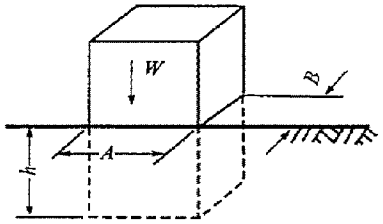

| | | | |
|---|---|---|---|
| *a* : Amplitude (cm) | 1.1 | *B* : Effective width (cm) | 310 |
| *W* : Weight (tf) | 21.5 | *n* : Number of applications (No.) | 2~4 |
| *F* : Oscillatory force (tf) | 87.7 | *t* : Time of application (min) | |
| *f*: Frequency (cpm) | 560 | *h* : Thickness of improvement (cm) | 400 |
| *A*: Effective width (cm) | 310 | | |

*Kiichi Tanimoto. Fundamental study for compaction due to surface vibration. doctor's thesis to Kyoto University, 1958.

* Compaction energy by both MVT Type-1 and Type-2 are larger than the compaction energy by the specified Dynamic Compaction.

Figure-6

METHOD OF SOIL COMPACTION AND DENSIFICATION

PRIORITY CLAIM

In accordance with 37 C.F.R. 1.76, a claim of priority is included in an Application Data Sheet filed concurrently herewith. Accordingly, the present invention claims priority to U.S. Provisional Patent Application No. 61/778,103, entitled "METHOD OF SOIL COMPACTION AND DENSIFICATION", filed Mar. 12, 2013. The contents of which the above referenced application is incorporated herein by reference.

FIELD OF INVENTION

The present invention relates to the field of construction and, more particularly, to a method of compacting soil.

BACKGROUND OF THE INVENTION

Soil compaction and densification is necessary where soil structure stability is necessary for load bearing capacity. This is especially critical in areas where limestone is present which is notoriously deceptive in its foundation strength especially when water is present. For purposes of example only the soil of South Florida in the United States will be discussed, however, this invention is not limited to the Florida geographical area. South Florida has a soil that includes limestone pinnacles/cavities in combination with sand wherein soil compaction and densification is necessary if the soil is to be used for load bearing purposes. Conventional soil compaction is performed by a deep dynamic compaction (DDC) technique wherein a 20 ton weight is lifted from the ground and allowed to free fall. The weight is lifted by a crane which requires operator skill in positioning during each free fall so that a new position is obtained. However, the free fall occurs from over 100 feet and the ability to hit the exact location is not precise resulting in lost time and higher cost of operation. More critically, should the operator miss the exact mark the soil compaction may fail in that area jeopardizes the foundation footings. Further, the vibration caused by the weigh falling can cause damage to surrounding structures. This becomes critical in high load areas such as airport runways where high static and dynamic loading can occur during airplane landings. Soil compaction needs are necessary around the world; however, the majority of Florida has a unique soil structure of sand and limestone. Well known are the sinks holes that form without notice and are capable of swallowing up a car, house or building. Florida's water table directly affects the soil. Further, the limestone can include pinnacles that must be addressed before any found is placed thereon. Use of a conventional dynamic compaction technique may miss the limestone pinnacles if the impact is not direct. Improper compaction will cause a lack of support and the defect could be concealed during the construction phase, only to cause problems in the future.

Mammoth vibro-tamper (MVT) is a known technology developed and applied in Japan. The MVT technology is a method to compact the surface of sandy ground by using equipment that consists of a strong vibrator and a larger tamping plate. While such a technique works well with sandy soil, a soil that is made of sand and limestone poses a unique situation. Soils that have limestone pinnacles, such as that found in Florida, typically use the dynamic impact process. However, it has been discovered that an adaptation of the MVT to a unique time and combination, provides a method to treat soil conditions having a double layer structure of sand and lime-rock.

SUMMARY OF THE INVENTION

A process for soil compaction for limestone and sand layers by providing an alternative to conventional soil compaction using deep dynamic compaction (DDC). Soil compaction of the instant invention is based upon a process in which multiple tamping sessions provide a stress to the soil causing densification as the air is displaced from the pores between the soil grains. The method comprises a first tamping session using a 10'×10' vibro tamper plate timed for about 90 seconds followed by at least 4 days of settling. A second tamping session using the 10'×10' vibro tamper plate timed for about 120 seconds followed by at least 4 days of settling. A third tamping session using a 7'×7' vibro tamper plate for about 90 seconds followed by about 6 days of settling.

An objective of the invention is to provide a method of shallow soil compaction that is an improvement over conventional dynamic compaction by providing a high production rate.

Still another objective of the invention is to provide a method of shallow soil compaction that can use a relatively low height of a crane rig.

Yet still another objective of the invention is to eliminate the need for dynamic compaction which is known for its high vibration and noise level.

Still another objective of the invention is to lessen the impact on neighboring structures.

Another objective of the invention is to provide 100 percent coverage by use of an overlapping strategy of grids and partitions, which is not possible by DDC.

Other objectives and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

BRIEF DESCRIPTION OF THE DRAWINGS

FIG. 1 is a chart depict the location of earthquakes where a vibro-tamper affected liquefaction mitigation;

FIG. 6 is a table comparison of compaction energy.

DETAILED DESCRIPTION OF THE PREFERRED EMBODIMENT

Figure 2:
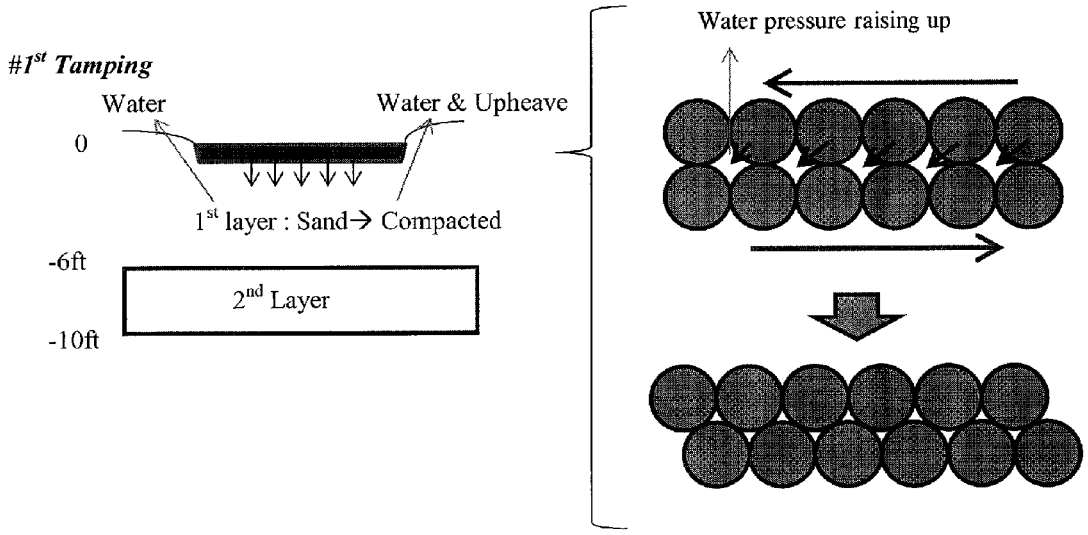
FIG. 2 is an illustration of a first tamping.

The mammoth vibro-tamper (MVT) is a ground improvement technique whereby loose soils can be effectively and economically densified and improved to permit development. The technique consists of the repeated impacting of the soils using a heavy weight which is vibrated using an electrically driven vibrator. Treatment is performed in a pre-planned grid pattern, the degree of improvement being dependent on the size of the weight, the frequency and amplitude of the vibrations, and the dwell time for each application of the tamper. The equipment consists of a heavy steel plate attached to a purpose-built, low frequency, high amplitude vibrator. The unit is suspended from a crane through a purpose-build shock absorber fitted to the main line. A control panel and generator are mounted on the back of the crane.

The vibro-tamper technical principle was developed and applied by Fudo Construction Co., Ltd. (predecessor of Fudo Tetra Corporation). In addition, the improved grounds by vibro-tamper have a reputation of enduring huge earthquakes in Japan. FIG. 1 is a map like illustration depicting the locations of huge earthquakes where liquefaction mitigation effect by vibro-tamper was verified. Of particular interest, the vibro-tamper technology has been applied for compaction of reclaimed land at Kansai International Airport and satisfied results have been obtained as shown. During the huge seismic motion of the Hyogoken Nambu Earthquake in 1995, there was no serious damage to the airport runway. Unique to MVT is the ability to use smaller cranes for movement of the tamping device, versus a free fall weight, and the reduction in vibration and noise associated with a free fall weight.

Unique to compaction is the soil found in Florida and parts of New Zealand which consists of sand and limestone. Of great concern is the limestone pinnacles that form and need to be dispersed for proper foundation. For instance, Ft. Lauderdale Airport located in Southeast Florida, U.S.A. in undergoing an expansion that revealed the issues of soil compaction for use with limestone pinnacles. In particular, Ft. Lauderdale is expanding the south runway from 100 feet to 150 feet and extending the length from 5,200 feet to 8000 feet. The steps necessary to effectively compact the soil for use in the runaway expansion begin with establishing a grid pattern for a worksite. The grid pattern developed for this invention consists of individual partitions of about 150'×120'. This permits a sized partition that reduces or eliminate the need for crane repositioning while the partition is being serviced. Before tamping begins, an SPT test of the individual partition is performed. This SPT test will be compared to a second SPT test when the tamping sessions are complete. A first tamping session is formed consisting of placing a first tamper plate sized about 10'×10' on an individual partition and initiate tamping in position for about 90 seconds. The first tamping session is repeated by overlapping each tamped position until the entire partition has been tamped. Upon completion of the first tamping session, the partition is allowed to settle for about 96 hours (4 days). It has been found that water and soil upheaval is expected during the first session wherein the pore water pressures that rises up from the first session is then allowed time to eliminate completely. The SPT (standard penetration test) is an in-situ dynamic penetration tests to provide information on the geotechnical engineering properties of the soil. The test is conventional and employs a sample tube that is driven into the ground at the bottom of a borehole using a slide hammer wherein the number of impacts needed to penetrate the tube is recorded providing an indication of the density of the ground for use in an empirical geotechnical engineering formula.

A second tamping session is then performed again using the first tamper plate on the first individual partition and the tamping is initiated in position for about 120 seconds. The tamping is repeated in subsequent positions wherein the tamping plate is partially overlapped on the previous tamping position until the first partition has been fully tampered a second time. The partition is then allowed to settle for about 96 hours (4 days). It has been found that no visible water and no upheaval occurs after the second session.

A third tamping session consisting of placing a second tamper plate having a size of about 7'×7' on the first individual partition and initiate tamping in position for about seconds. The third tamping session is repeated throughout the partition by overlapping each tampered position until the partition has been fully tampered. After each session is completed, but no earlier than six days after an individual partition has been completed, the soil is retested for compaction.

Figure 3:
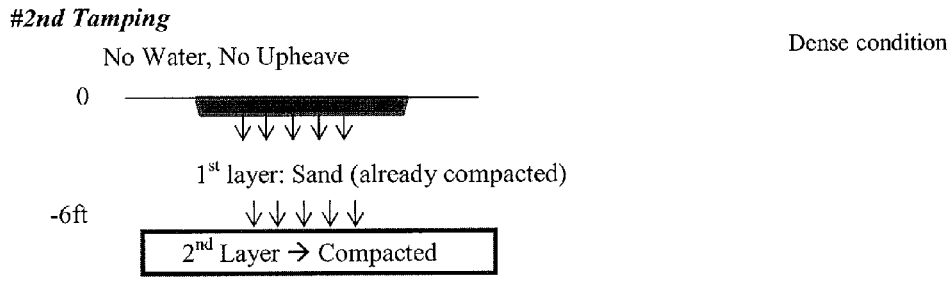
FIG. 3 is an illustration of a second tamping.

The vibration method using two separate tampers is quite effective for the sandwich layer structure of sand and limestone in Florida from test trials. Referring to FIG. 2, set forth is a 1st tamping illustration where some amount of water tends to come up from the ground to the surface. The pore water pressure tends to become high (Dilatancy effect) because of shear deformation during tamping. The compaction energy seems to be consumed by the compaction in upper loose sand layer only, so the limestone layer below remains loose. Referring to FIG. 3, after the second tamping no water came to the surface and substantial settlement in the range of 0.5 feet to 2 feet is observed. This suggests that the upper sand layer was densified already and the loose limestone layer was well compacted after the second tamping due to sufficient compaction energy through the densified sand layer.

The preferred vibro-tamping device is moved by a crawler crane having an 80-250 ton capacity with a three part sheave block. It is noted that the crane is used only for positioning of the tamping plate, as opposed to the conventional dynamic compaction technique wherein a 20 ton weight is lifted upwards of 100 feet from the ground and allowed to free fall. For this reason a relatively low crane can be used which is a benefit in cost, safety in high winds, and safety around airports where any high crane can be a hazard. The first tamping plate is a 10'×10' unit, preferably a 340 KVA generator is used in operation. The second tamping plate is a 7'×7' unit. While the two sizes listed are preferred, the concept is directed to the use of two different sized tamping plates, the first being larger than the second by about one third size. The tamping plates preferably include a cross plate attachment on the impact side used as a temporary anchor to prevent the tamping unit from walking. The cross plate is about 24" deep and about 1"thick, two plates are welded to the impact side in a cross pattern to prevent waling in any direction.

Figure 4:
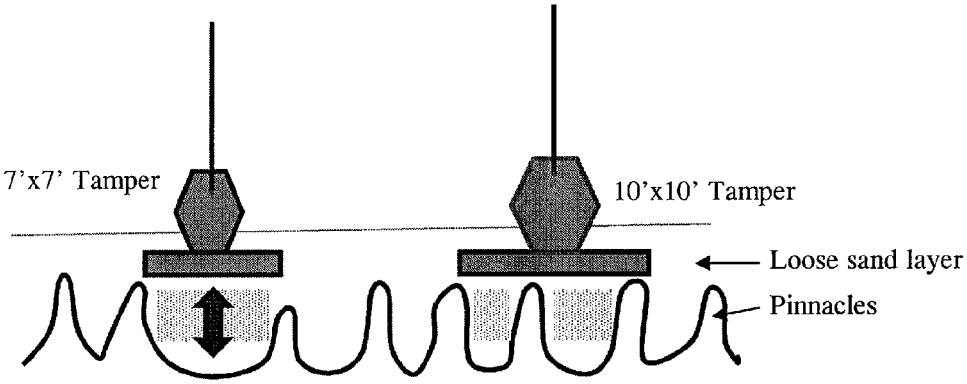
FIG. 4 is an illustration of a first and second tamping unit operating over limestone pinnacles.
Figure 5:
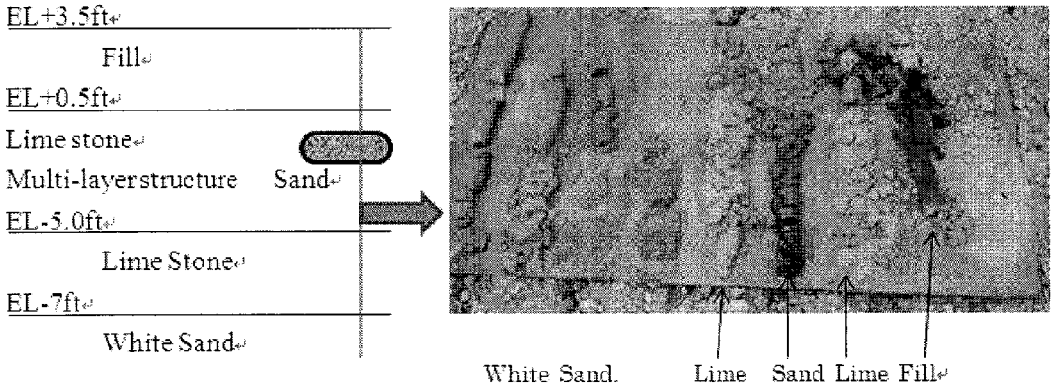
FIG. 5 depicts a sandwich layer structure.

The second tamping plate, such as 7'×7' is effective to compact loose sand in between pinnacles as shown in FIG. 4. FIG. 5 depicts a sandwich layer structure with an elevation at +3.5 ft, limestone and multi-layer structure between +0.5 ft to −5.0 ft, limestone material layer at −5.0 ft and white sand material layer at −7.0 ft.

Referring to FIG. 6, with regard to the compaction energy, MVT has higher energy level than the energy of conventional DDC. For instance, if we assume 100 seconds MVT tamping, the energy level is estimated as follows:

$$E(MVT\ 7'\times7'):E(MVT\ 10'\times10'):E(DDC)=2.4:1.8:1$$

In spite of the high compaction energy, vibration levels at the surrounding ground and facility during MVT operation is lower than that of DDC operation. In general, MVT operation will not cause serious damage to the surrounding structures as long as the distance of more than 10 meters (33 feet) is kept.

In conditions of very hard lime-rock layer or rock, it can be difficult to break the layer and properly compact the sand between the layers. In such instances the use of prefacturing is desired by use a drilling or trenching. Drilling can be used to break the lime-rock coverage prior to tamping, the drilling is by an auger machine with the holes arranged in a pattern to provide proper breaching of the lime-rock layer. Trenching is performed by an excavator that digging a trench about every 10 feet. Both the drill hole and the trench should be between 10 and 20 feet deep.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A method of compacting soil containing limestone pinnacles and cavities comprising the steps of:

establishing a grid pattern at a worksite, said grid pattern consisting of individual partitions;

performing an initial Standard Penetration Test ("SPT") of said individual partitions;

performing a first tamping session consisting of tamping one of said individual partitions with a first tamper plate of a predetermined size and weight, and overlapping each tampered position until the entire grid pattern of individual partitions has been tampered;

performing a second tamping session about 96 hours after said first tamping session, said second tamping session consisting of tamping one of said individual partitions with said first tamper plate and overlapping each tampered position until the entire grid pattern has been tampered;

performing a third tamping session about 96 hours after said second tamping session, said third tamping session consisting of tamping one of said individual partitions with a second tamper plate of a size less than the size of said first tamper plate and overlapping each tampered position until the entire grid pattern has been tampered;

wherein each said tamping session is timed to coincide with pore water pressure causing soil moisture caused through a dilatancy effect to provide soil compaction with minimal noise and vibration.

2. The method of soil compaction according to claim 1 wherein said individual partitions are about 120'×150'.

3. The method of soil compaction according to claim 1 wherein said first tamper plate is a vibro plate about 10'×10'.

4. The method of soil compaction according to claim 1 wherein said second tamper plate is a vibro plate about 7'×7'.

5. The method of soil compaction according to claim 1 including the step of performing a second SPT of said individual partitions about six days after said third tamping session has been completed and comparing the results with the initial SPT.

6. The method of soil compaction according to claim 1 wherein said first tamping session is about 90 seconds in a fixed position.

7. The method of soil compaction according to claim 1 wherein said second tamping session is about 120 seconds in a fixed position.

8. The method of soil compaction according to claim 1 wherein said third tamping session is about 90 seconds in a fixed position.

9. The method of soil compaction according to claim 1 including the step of prefacturing lime-rock formations formed in soil containing limestone pinnacles and cavities prior to tamping.

10. The method of soil compaction according to claim 9 wherein said step of prefacturing lime-rock coverage is performed by use of a series of holes drilled 10-20 feet deep.

11. The method of soil compaction according to claim 9 wherein said step of prefacturing lime-rock coverage is performed by use of digging a series of trenches 10-20 feet deep prior to said first tamping session.

12. The method of soil compaction according to claim 1 wherein at least one said tamping plate includes a cross shaped protrusion to prevent said tamping plate from walking during a tamping session.

* * * * *